United States Patent [19]

Ullmann

[11] 4,143,778

[45] Mar. 13, 1979

[54] SHOVEL ATTACHMENT MEANS FOR HYDRAULIC EXCAVATOR

[75] Inventor: Karl H. Ullmann, Dortmund, Fed. Rep. of Germany

[73] Assignee: Harnischfeger Corporation, Milwaukee, Wis.

[21] Appl. No.: 897,715

[22] Filed: Apr. 19, 1978

Related U.S. Application Data

[62] Division of Ser. No. 803,356, Jun. 3, 1977, Pat. No. 4,103,791.

[51] Int. Cl.[2] ..... E02F 3/30

[52] U.S. Cl. ..... 414/694; 414/708

[58] Field of Search ..... 214/131 R, 138 R, 770, 214/771, 776

[56] References Cited

U.S. PATENT DOCUMENTS

| | | | |
|---|---|---|---|
| Re. 25,495 | 12/1963 | Soyland et al. | 214/138 R |
| 1,371,344 | 3/1921 | Brackett | 214/138 R X |
| 2,660,816 | 12/1953 | Maxwell | 214/138 R X |
| 3,129,832 | 4/1964 | Metailler | 214/138 R |
| 3,606,060 | 9/1971 | Fleming et al. | 214/771 |
| 3,828,950 | 8/1974 | Schwantes | 214/138 R |

FOREIGN PATENT DOCUMENTS

| | | | |
|---|---|---|---|
| 167063 | 2/1956 | Australia | 214/138 R |

*Primary Examiner*—L. J. Paperner
*Attorney, Agent, or Firm*—James E. Nilles

[57] ABSTRACT

A large hydraulic excavator machine for mining operations comprises attachment means for operatively connecting the shovel to the machine frame so that no bending moment is imposed on the component parts of the attachment means during operation of the excavator. The attachment means comprises components including a stroke arm movable by an extendable and retractable hydraulic stroke arm cylinder; and a shovel arm assembly on which the bucket is mounted and which is movable by an extendable and retractable hydraulic shovel arm cylinder. The stroke arm and stroke arm cylinder are pivotally connected at their lower ends to spaced apart points on the excavator frame and are pivotally connected at their upper ends to a common point. The upper end of the shovel arm assembly is also connected to the common point. The shovel arm cylinder has one end pivotally connected to the machine frame (or to an extension therefrom) and has its other end pivotally connected to the shovel arm assembly. The lattice-like arrangement of the components and the location of the points of attack of the stroke arm cylinder and the shovel arm cylinder prevent bending moments from being imposed on the components.

4 Claims, 15 Drawing Figures

SHOVEL ATTACHMENT MEANS FOR HYDRAULIC EXCAVATOR

REFERENCE TO RELATED CO-PENDING APPLICATION

This application is a divisional from application Ser. No. 803,356, filed on June 3, 1977, now U.S. Pat. No. 4,103,791.

BACKGROUND OF THE INVENTION

1. Field of Use

This invention relates generally to excavating machines, such as hydraulic mining shovels or the like, and in particular to attachment means for the shovel.

2. Description of the Prior Art

In large excavating machines, such as hydraulic mining shovels or the like, the attachment means for the shovel are designed to enable the shovel to be movable through a wide range of positions while excavating, handling and unloading heavy loads of overburden, ore or the like. Maximum desirable shovel movement and articulation require the attachment means to employ numerous pivotably movable interconnected components, such as arms, links and beams, and, in some instances, one or more extendable and retractable hydraulic cylinders or rams which effect movement of other components, as well as serving a supporting function. In some prior art machines, the shovel attachment means are designed in such a manner that some components are subject to undesirable bending stresses either continually or at least whenever certain operating functions are performed. Such stresses can shorten the life of the component or its pivot pin and bearing means, thereby creating possible danger to men and equipment during operation and also necessitating costly repairs and downtime. Very often design requirements of a particular machine necessitate a trade-off between functional requirements and acceptable stress factors. Typically, a bending moment occurs in a beam when a load and a reactive force (such as is imposed by a hydraulic cylinder) are imposed in the same direction on opposite sides of a beam pivot point.

The prior art discloses excavating and material handling machines of many types wherein various components in the shovel attachment means are subjected to bending moments. See, for example, U.S. Pat. Nos. 3,990,161; 3,491,906; and 3,370,729; German Pat. Nos. 2,136,007 and 2,011,262; and Australian Pat. No. 401,738.

SUMMARY OF THE PRESENT INVENTION

In accordance with the present invention, there is provided a large excavator, such as is used in mining operations or the like, and which comprises attachment means for a shovel, backhoe, or the like. The attachment means is constructed so that no bending stresses, strains, or moments are imposed on any component thereof during operation of the excavator.

The excavator has a lower section comprising a lower frame or chassis, at least a pair of ground-engaging motor driven crawler tracks mounted on the lower frame; and a slew ring mounted on the lower frame upon which an upper section is supported and mounted for horizontal rotation or swing in either direction. The upper section comprises an upper frame having means whereby it is rotatably mounted on the slew ring; a machine house on the frame for necessary equipment such as engines, pumps, and controls; an operator's cab mounted on the upper frame for housing the machine operator and his control levers; and shovel attachment means in accordance with the invention mounted on the upper frame and to which a shovel, backhoe, or the like is mounted. The shovel attachment means are designed, constructed, and arranged so that the movable parts thereof are not subjected to any bending moments, stresses, or strains.

In accordance with the invention there is provided a shovel attachment means for mounting on the excavating machine frame and comprising: a stroke arm; a stroke arm cylinder; a shovel arm assembly; a shovel arm cylinder; a shovel; means for connecting the shovel to the shovel arm assembly and a shovel cylinder for pivotally moving the shovel thereon.

In all embodiments, one end of the stroke arm is pivotally connected to a first point on the frame. One end of the stroke arm cylinder is pivotally connected to a second point on the frame. The other end of the stroke arm and the other end of the stroke arm cylinder are pivotally connected to a common point. A point on the shovel arm assembly is also connected to the said common point. One end of the shovel arm cylinder is pivotally connected, in effect, to a point on the frame. The other end of the shovel arm cylinder is pivotally connected to a point on the shovel arm assembly, which point is spaced from the said common point.

In some embodiments, the shovel arm assembly comprises a rigid beam having an upper end which is connected to the said common point; and one end of the shovel arm cylinder is pivotally connected to the same point on the frame whereat the stroke arm or stroke arm cylinder is connected. The stroke arm can be a rigid beam or a hydraulic cylinder.

In some embodiments the shovel arm assembly is a multi-beam assembly and comprises a first beam section, a second beam section, and means for pivotally connecting the second beam section on the first beam section. In such embodiments the first beam section is connected to the stroke arm at the said common point; and the other end of the shovel arm cylinder is connected to the second beam section.

In one embodiment of the multi-beam shovel arm assembly, the first beam section of the shovel arm assembly is rigidly connected to the stroke arm near the said common point, and one end of the shovel end cylinder is pivotally connected to the first beam section.

In another embodiment of the multi-beam shovel arm assembly the first beam section of the shovel arm assembly is pivotally connected to the stroke arm and to the stroke arm cylinder at the said common point and one end of the shovel end cylinder is pivotally connected to the frame.

DESCRIPTION OF THE PREFERRED EMBODIMENT

General Arrangement

Figure 7:
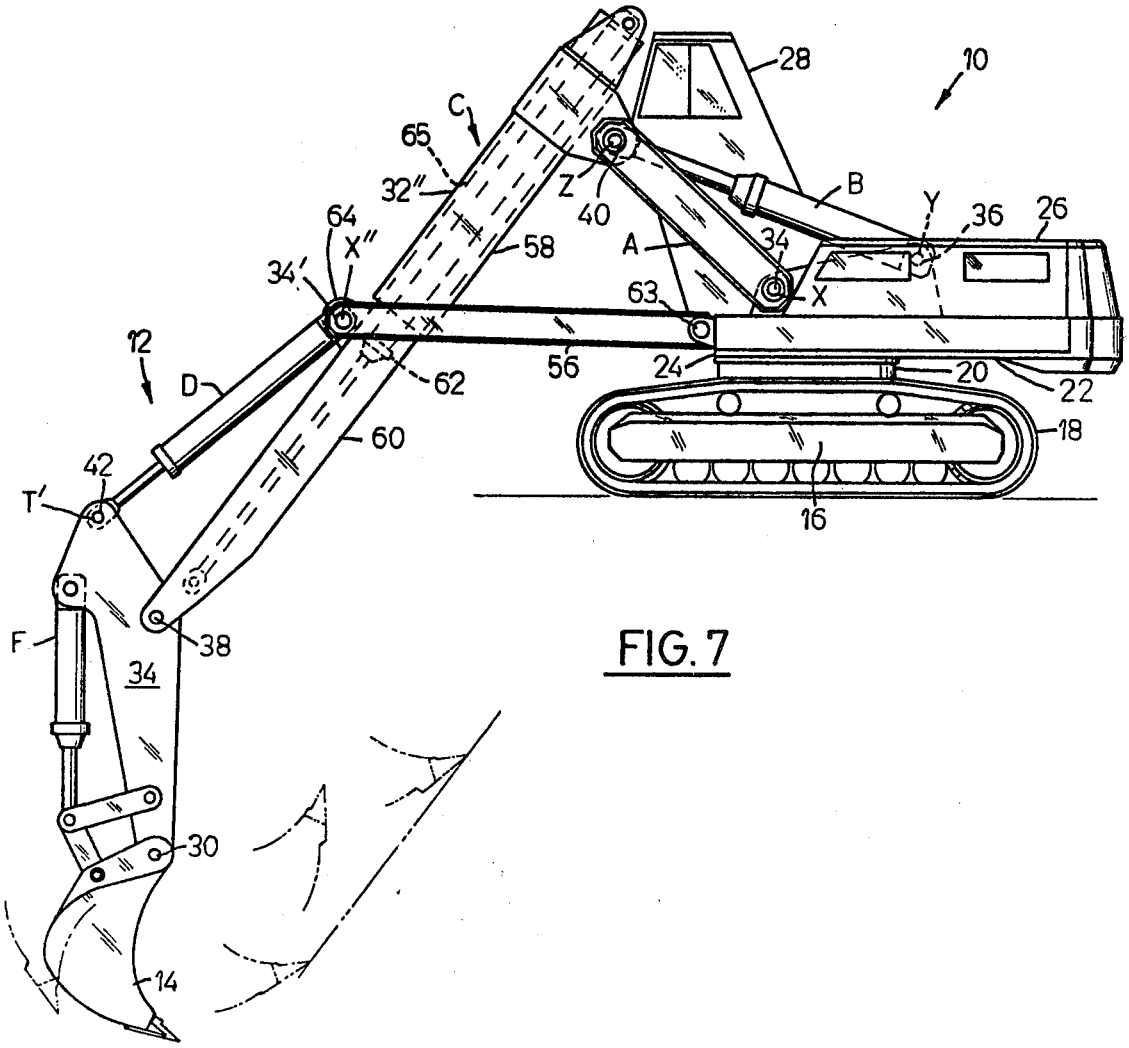
FIG. 7 is a side elevational view of an excavating machine in accordance with a fourth embodiment of the invention.
Figure 5:
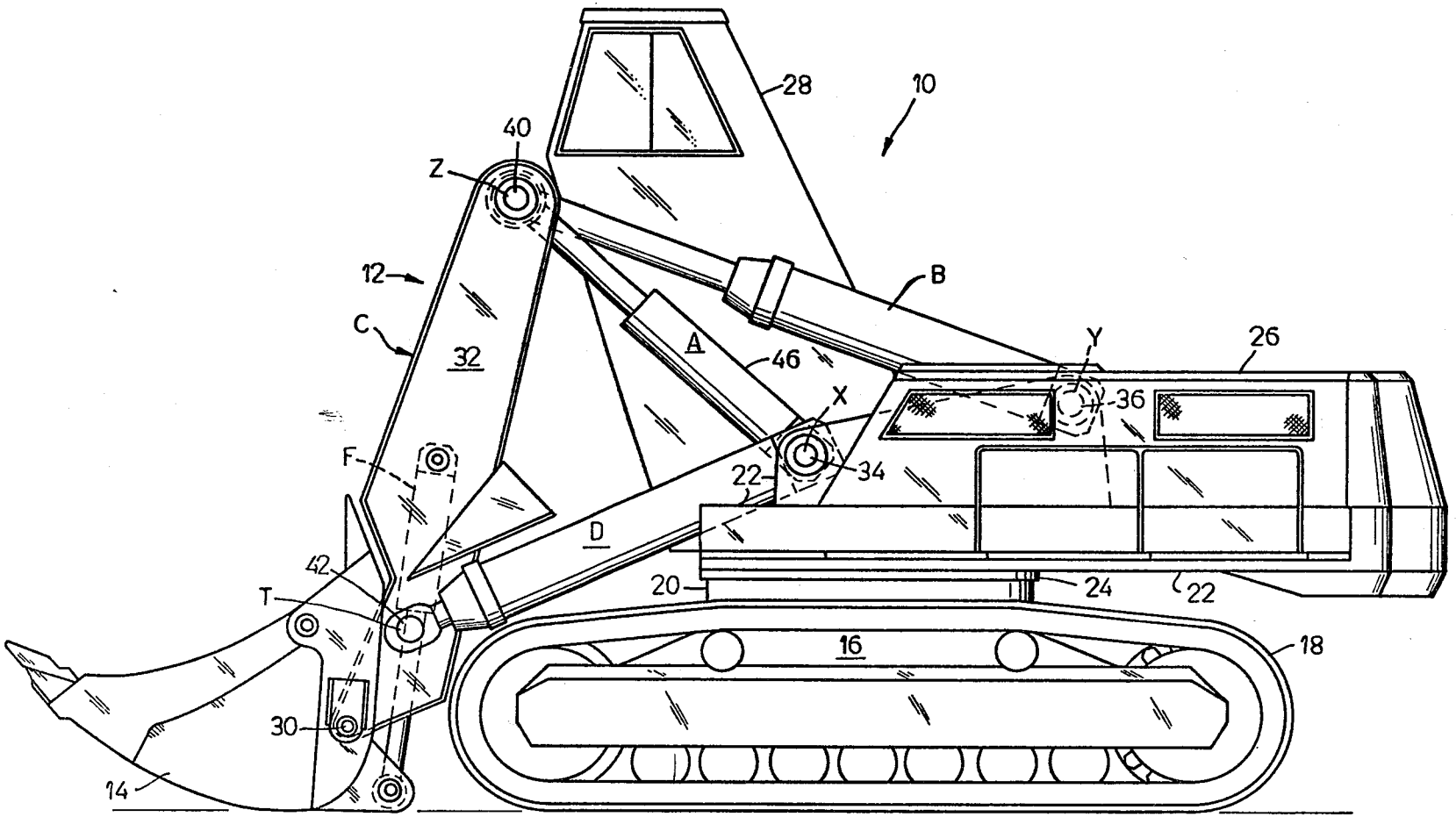
FIG. 5 is a side elevational view of an excavating machine in accordance with a second embodiment of the invention.
Figure 6:
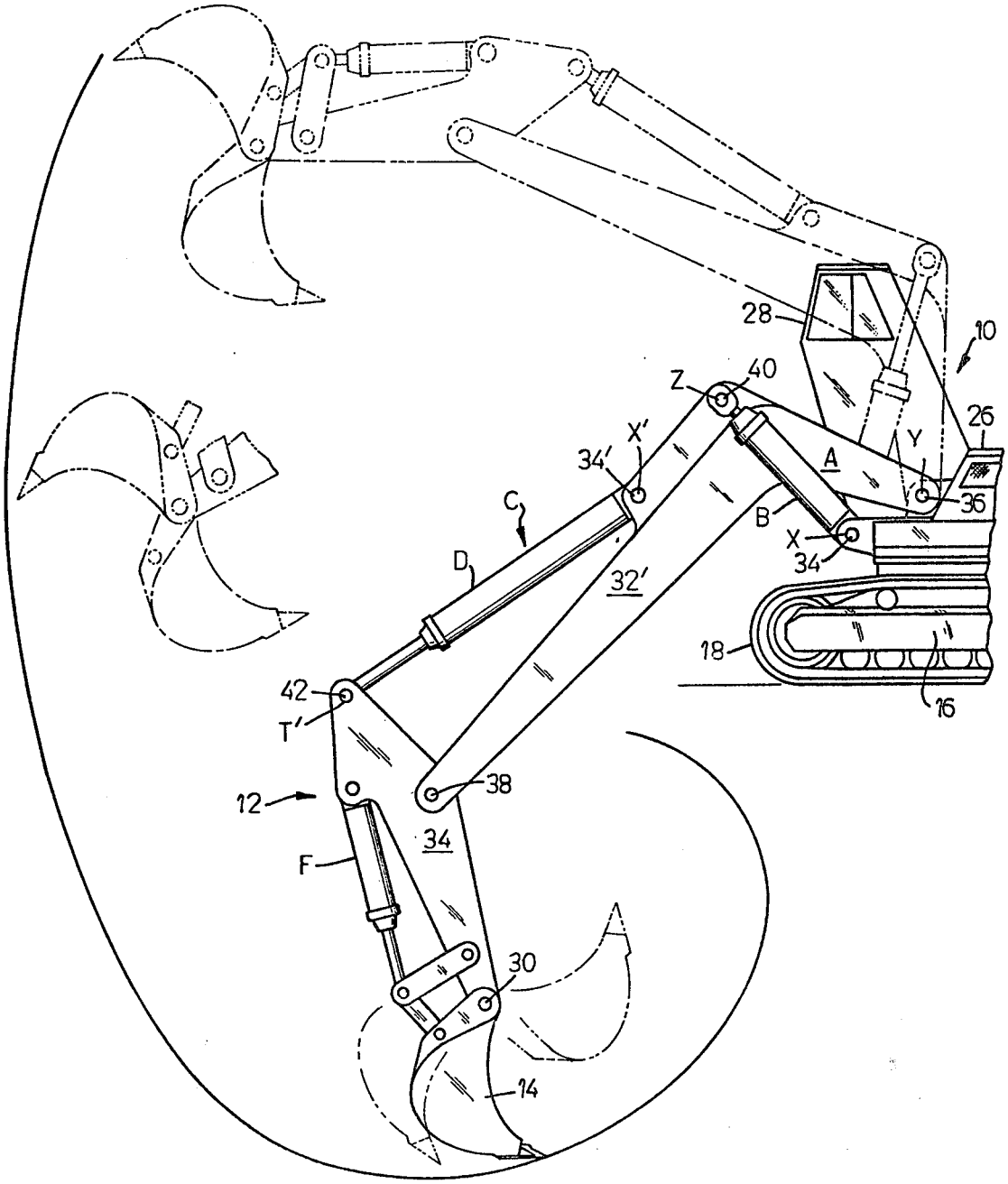
FIG. 6 is a side elevational view of an excavating machine in accordance with a third embodiment of the invention.
Figure 10:
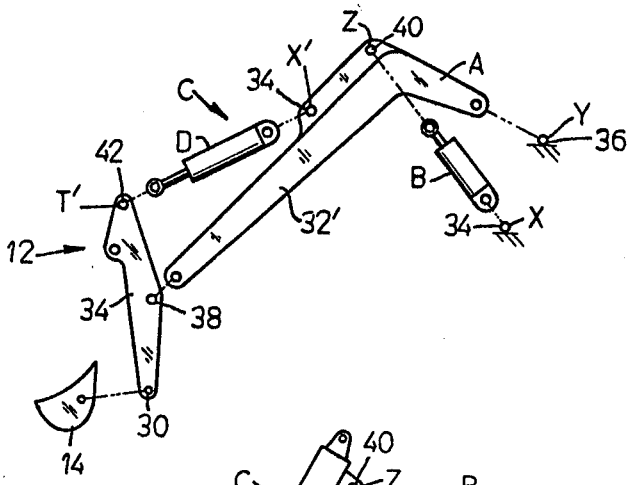
Figure 11:
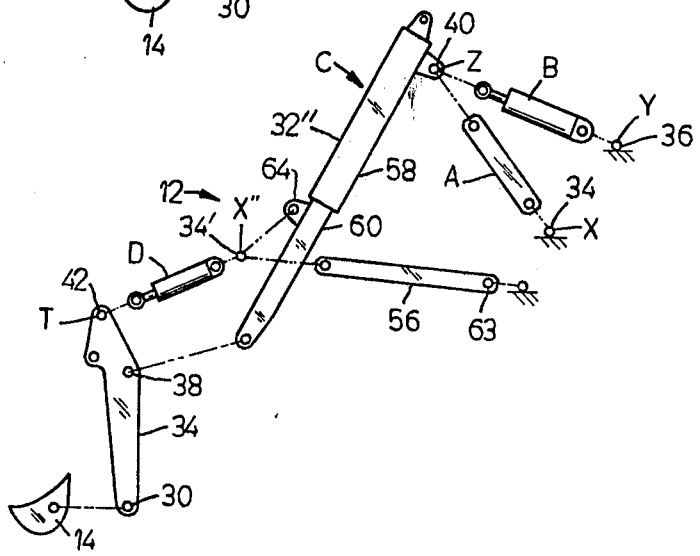

Five embodiments are shown. FIGS. 1, 2, 3, 4, and 8 depict the first embodiment of the invention in the form of a mining shovel. FIGS. 5 and 9 depict a second embodiment of the invention in the form of a mining shovel. FIGS. 6 and 10 depict a third embodiment of the invention in the form of a backhoe. FIGS. 7 and 11 depict a fourth embodiment of the invention in the form of a backhoe having a telescopic boom. FIGS. 12, 13, 14 and 15 depict a fifth embodiment. In the first and second embodiments, the shovel is employed to scrape or dig in a direction away from the machine. In the second and third embodiments, the shovel is employed to scrape or dig in a direction toward the machine. In each of the five embodiments, the excavating machine, except for the shovel and shovel attachment means, is the same. Similar components, elements, and points in the five embodiments are designated by the same reference characters.

Each of the five excavators 10 has a lower section comprising a lower frame or chassis 16, a pair of ground-engaging motor driven crawler tracks 18 mounted on the lower frame; and a slew ring 20 mounted on the lower frame upon which an upper section is supported and mounted for horizontal rotation or swing in either direction. The upper section comprises an upper frame 22 having means 24 whereby it is rotatably mounted on the slew ring 20; a machine house 26 on the frame 22 for necessary equipment such as engines, pumps, and controls; an operator's cab 28 mounted on the upper frame 22 for housing the machine operator and his control levers; and shovel attachment means 12 in accordance with the invention mounted on the upper frame 22 and on which a shovel 14 is mounted. The shovel attachment means 12 of each embodiment are designed, constructed, and arranged so that the movable parts thereof are not subjected to any bending moments, stresses, or strains.

First Embodiment

Turning now to the first embodiment of the invention of FIGS. 1, 2, 3, 4, and 8, the shovel attachment means 12, which is mounted on the excavating machine upper frame 22, comprises a stroke arm A, a stroke arm cylinder B, a shovel arm assembly C in the form of a shovel arm or rigid beam 32, a shovel arm cylinder D, shovel 14, means including a pivot pin 30 for pivotally connecting the shovel 14 to the shovel arm assembly C and a shovel cylinder F connected between the shovel and arm 32 in the shovel arm assembly C.

One (lower) end of the stroke arm A is pivotally connected by means of a pin 34 to a first point X on the frame 22. One (lower) end of the stroke arm cylinder B is pivotally connected by means of a pin 36 to a second point Y on the frame 22. The points X and Y are spaced apart from each other and the point X is nearest the working end of the machine. The other (upper) end of the stroke arm A and the other (upper) end of the stroke arm cylinder B are pivotally connected by means of a pin 40 to each other at a common point Z. A point on the shovel arm assembly C, namely the upper end of shovel arm 32, is also connected by means of pin 40 to common point Z. One (inner) end of the shovel arm cylinder D is pivotally connected by means of pin 34 to point X on the frame 22. The other (outer) end of the shovel arm cylinder D is pivotally connected by means of a pin 42 to a point T on the shovel arm 32 of the shovel arm assembly C near the lower end thereof. Point T is spaced from the common point Z.

Figure 1:
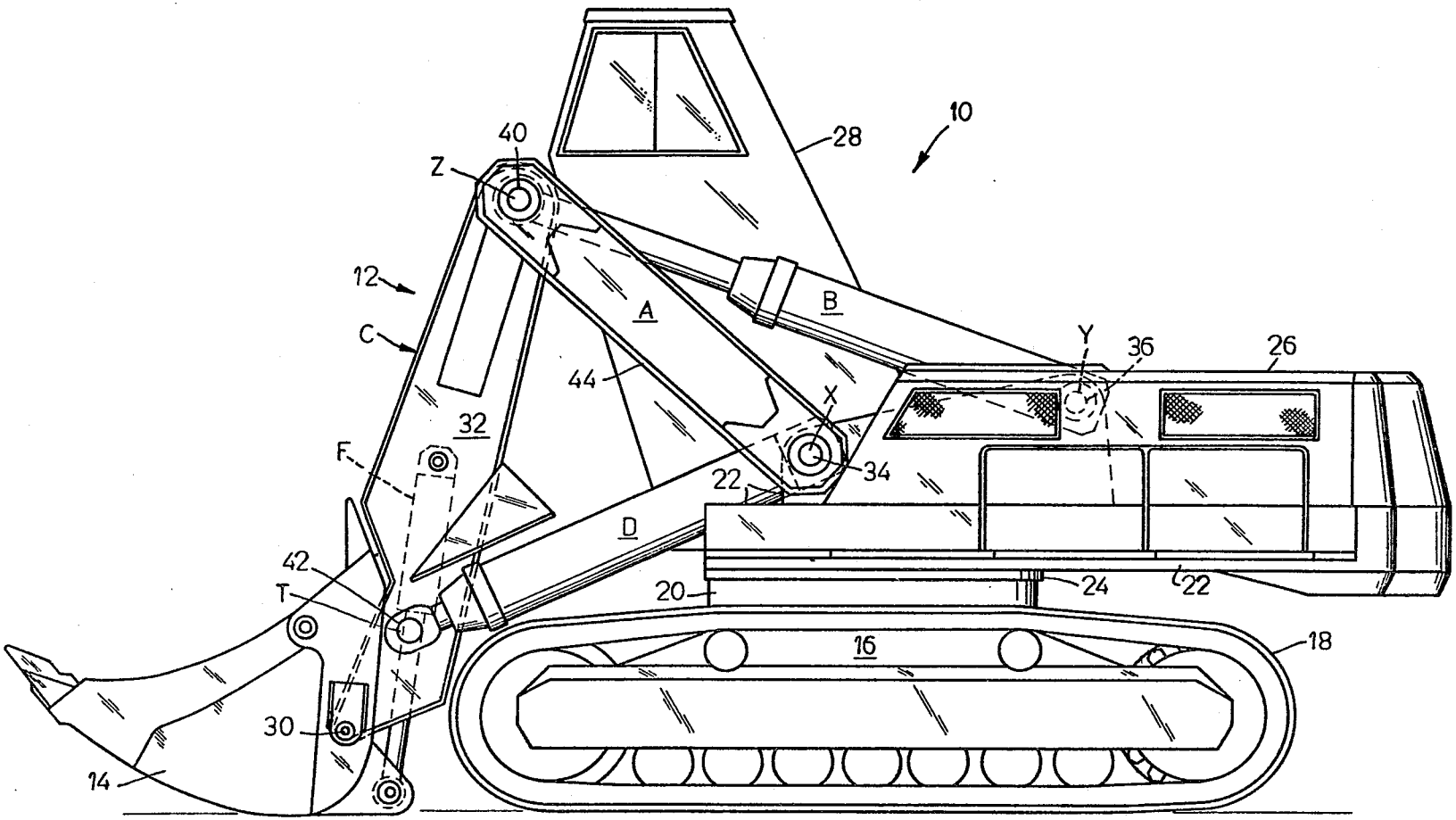
FIG. 1 is a side elevational view of an excavating machine in accordance with a first embodiment of the invention.
Figure 2:
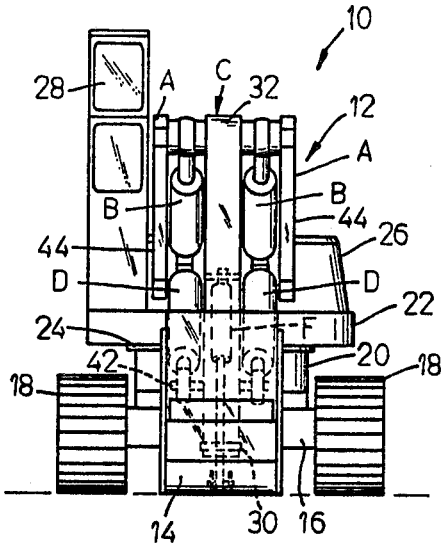
FIG. 2 is a front elevational view of the machine shown in FIG. 1.
Figure 3:
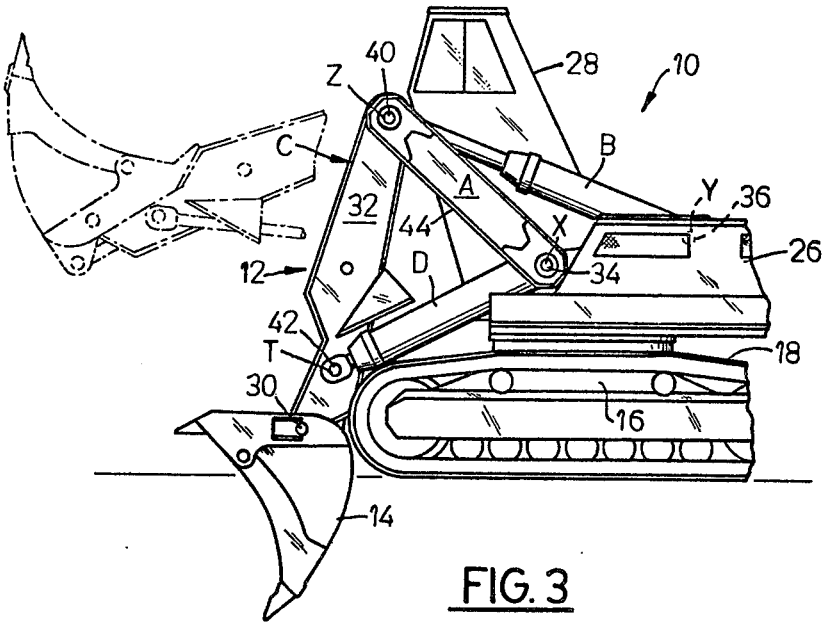
FIG. 3 is a side elevational view, in reduced scale, of the machine of FIG. 1 showing it with its shovel in fully lowered position.
Figure 4:
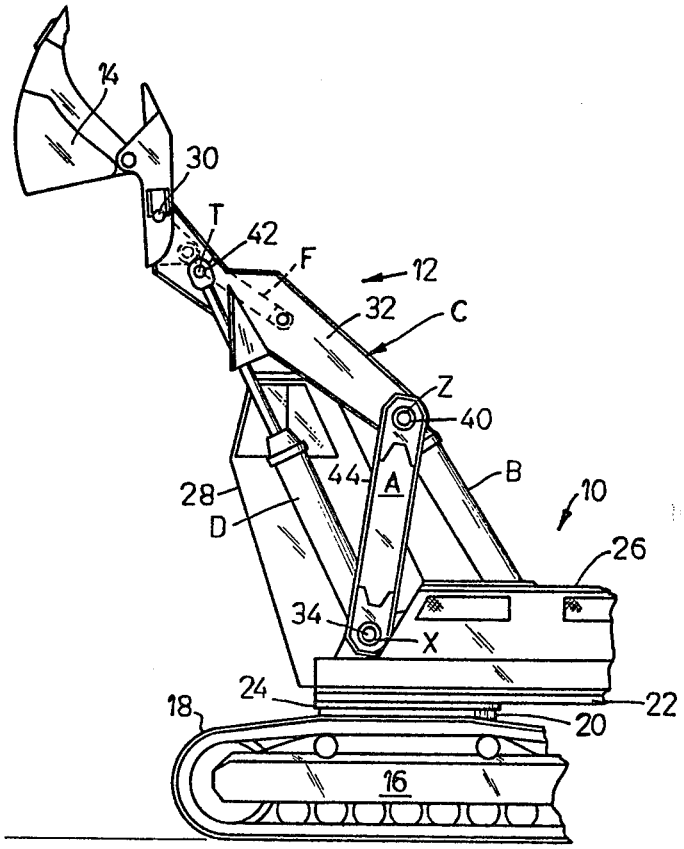
FIG. 4 is a view similar to FIG. 2 showing the shovel in fully raised position.

As FIGS. 1, 2, and 3 show, extension and retraction of stroke arm cylinder B effects pivotal movement of stroke arm A about pivot point X. Extension and retraction of shovel arm cylinder D effects pivotal movement of shovel arm 32 about point Z. Extension and retraction of shovel cylinder F effects rotation of shovel 14 about pivot pin 30. As the cylinders B and D are operated, they pivot about the points Y and X, respectively. In FIG. 1, the shovel 14 is shown at rest on the surface of the earth. In FIG. 2, the shovel 14 is shown tipped downwardly for digging purposes and is shown in phantom lines placed in a raised position by means of extension of shovel arm cylinder D. In FIG. 3, stroke arm cylinder B is fully retracted and shovel arm cylinder D is fully extended to cause the shovel 14 to be placed in its uppermost position.

The point of attack for the stroke arm cylinder B is point Z at the upper ends of the stroke arm A and the shovel arm 32. The point of attack for the shovel arm cylinder D is point T near the lower end of shovel arm 32. As is apparent during operation, then, neither the cylinders B or D or the beams A or 32 are subjected to any bending moments. All loads are compression or tension loads running along the axial lengths of the various components making up the attachment means 12.

Second Embodiment

Turning now to the second embodiment of the invention shown in FIGS. 5 and 9, it is seen that the second embodiment is identical in all respects to the first embodiment except that in the first embodiment the stroke arm A takes the form of a rigid beam 44, whereas in the second embodiment, the stroke arm A takes the form of an extendable and retractable cylinder 46. The arrangement in the second embodiment enables a wider range of movement for shovel 14 because the shovel arm 32 is not only pivotable about point Z but is movable toward and away from the machine as point Z is so moved by extension and retraction of the stroke arm cylinder B and the cylinder 46 serving as the stroke arm A.

Third Embodiment

Turning now to the third embodiment of the invention shown in FIGS. 6 and 10, the shovel attachment means 12, which is mounted on the excavating machine upper frame 22, comprises a stroke arm A, a stroke arm cylinder B, a shovel arm assembly C, a shovel arm cylinder D, shovel 14, means including a pivot pin 30 for pivotally connecting the shovel 14 to the shovel arm assembly C and a shovel cylinder F connected between the shovel and the shovel arm assembly C. Shovel arm assembly C comprises a first beam section 32', a second beam section 34, and means including a pin 38 for pivotally connecting the second beam section on the first beam section. The first beam section 32' is integral with stroke arm A.

One (lower) end of the stroke arm A is pivotally connected by means of a pin 36 to a first point Y on the frame 22. One (lower) end of the stroke arm cylinder B is pivotally connected by means of a pin 34 to a second point X on the frame 22. The points X and Y are spaced apart from each other and the point X is nearest the working end of the machine. The other (upper) end of the stroke arm A and the other (upper) end of the stroke arm cylinder B are pivotally connected by means of a pin 40 to each other at a common point Z. A point on the shovel arm assembly C, namely the upper end of first beam section 32', is also connected by means of pin 40 to common point Z. One (inner) end of the shovel arm cylinder D is pivotally connected by means of pin 34' to a point X' on the first beam section 32'. The other (outer) end of the shovel arm cylinder D is pivotally connected by means of a pin 42 to a point T' near one end of the second beam section 34 which serves as a shovel arm of the shovel arm assembly C.

As FIGS. 6 and 10 show, extension and retraction of stroke arm cylinder B effects pivotal movement of stroke arm A (and first beam section 32') about pivot point Y. Extension and retraction of shovel arm cylinder D effects pivotal movement of shovel arm 34 about pin 38. Extension and retraction of shovel cylinder F effects rotation of shovel 14 about pivot pin 30. As the cylinder B is operated, it pivots about the point X.

The point of attack for the stroke arm cylinder B is point Z at the upper ends of the stroke arm A and first beam section 32'. The point of attack for the shovel arm cylinder D is point T' at the upper end of second section 34. As is apparent during operation, then, neither the cylinders B or D or the beams A or 32' are subjected to any bending moments. All loads are compression or tension loads running along the axial lengths of the various components making up the attachment means 12.

Fourth Embodiment

Turning now to the fourth embodiment of the invention shown in FIGS. 7 and 11, the shovel attachment means 12, which is mounted on the excavating machine upper frame 22, comprises a stroke arm A, a stroke arm cylinder B, a shovel arm assembly C, a shovel arm cylinder D, shovel 14, means including a pivot pin 30 for pivotally connecting the shovel 14 to the shovel arm assembly C and a shovel cylinder F connected between the shovel and the shovel arm assembly C. Shovel arm assembly C comprises a first telescopic beam section 32'', a second beam section 34, and means including a pin 38 for pivotally connecting the second beam section on the first telescopic beam section.

One (lower) end of the stroke arm A is pivotally connected by means of a pin 34 to a first point X on the frame 22. One (lower) end of the stroke arm cylinder B is pivotally connected by means of a pin 36 to a second point Y on the frame 22. The points X and Y are spaced apart from each other and the point X is nearest the working end of the machine. The other (upper) end of the stroke arm A and the other (upper) end of the stroke arm cylinder B are pivotally connected by means of a pin 40 to each other at a common point Z. A point on the shovel arm assembly C, namely the upper end of first telescopic beam section 32'', is also connected by means of pin 40 to common point Z. One (inner) end of the shovel arm cylinder D is pivotally connected by means of pin 34' to a point X'' on the outer end of an extension on beam 56 which is pivotally connected at its inner end to frame 22 by means of a pin 62. The other (outer) end of the shovel arm cylinder D is pivotally connected by means of a pin 42 to a point T' near one end of the second beam section 34 which serves as a shovel arm of the shovel arm assembly C. Telescopic beam section 32'' comprises two relatively movable portions 58 and 60 which are extendable and retractable by means of a hydraulic cylinder 62 therewithin.

As FIGS. 7 and 11 show, extension and retraction of stroke arm cylinder B effects pivotal movement of stroke arm A (and first telescopic beam section 32'') about pivot point X. Extension and retraction of shovel arm cylinder D effects pivotal movement of shovel arm 34 about point 38. Extension and retraction of shovel cylinder F effects rotation of shovel 14 about pivot pin 30. As the cylinder B is operated, it pivots about the point Y.

The point of attack for the stroke arm cylinder B is point Z at the upper ends of the stroke arm A and first beam section 32''. The point of attack for the shovel arm cylinder D is point T' at the upper end of second section 34. As is apparent during operation, then, neither the cylinders B or D or the beams A or 32'' are subjected to any bending moments. All loads are compression or tension loads running along the axial lengths of the various components making up the attachment means 12.

As is apparent from the foregoing description, in all embodiments, one (lower) end of the stroke arm A is pivotally connected to a first point X on the frame 22. One (lower) end of the stroke arm cylinder B is pivotally connected to a second point Y on the frame 22. The other (upper) end of the stroke arm A and the other (upper) end of the stroke arm cylinder B are pivotally connected to a common point Z. A point on the shovel arm assembly C is also connected to the common point Z. One end of the shovel arm cylinder D is pivotally connected, in effect, to a point on the frame 22. The other end of the shovel arm cylinder D is pivotally connected to a point T on the shovel arm assembly C, which point T is spaced from the common point Z.

Figure 8:
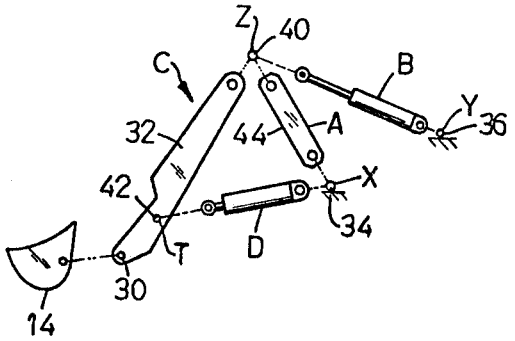
FIGS. 8, 9, 10, and 11 are schematic diagrams of the attachment means of the machine shown in FIGS. 1, 5, 6, and 7, respectively.
Figure 9:
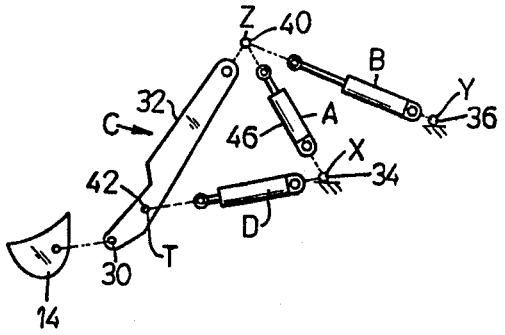

In the embodiments shown in FIGS. 8 and 9, the shovel arm assembly C comprises a rigid beam 32 having an upper end which is pivotally connected to the common point Z; and one end of the shovel arm cylinder D is pivotally connected to the same point X on the frame 20 whereat the stroke arm A is connected. The stroke arm A can be a rigid beam 34, as shown in FIGS. 1–4 and 8, or a hydraulic cylinder 36, as shown in FIGS. 5 and 9.

In the embodiments shown in FIGS. 10 and 11, the shovel arm assembly C is a multi-beam assembly and comprises a first beam section 32′ (FIGS. 6 and 10) or 32″ (FIGS. 7 and 11), a second beam section 34, and means including a pin 36 for pivotally connecting the second beam section 34 on the first beam section 32′ or 32″, respectively. In the embodiments of FIGS. 6, 10, and FIGS. 7, 11, the first beam section 32′, 32″ is connected to the stroke arm A at the common point Z; and the other end of the shovel arm cylinder D is connected to the second beam section 34.

In the embodiment of the multi-beam shovel arm assembly shown in FIGS. 6 and 10, the first beam section 32′ of the shovel arm assembly C is rigidly connected to the stroke arm B′ and the stroke arm cylinder A′ near the common point Z, and one end of the shovel arm cylinder D is pivotally connected to the first beam section 32′.

In the embodiment of the multi-beam shovel arm assembly shown in FIGS. 7 and 11, the first beam section 32′ of the shovel arm assembly C is pivotally connected to the stroke arm A and to the stroke arm cylinder B at the common point Z and one end of the shovel arm cylinder D is pivotally connected to the frame at a point X′.

As FIG. 2 makes clear, the hydraulic excavator machine 10 is designed for heavy-duty operations and as a result, there are a pair of cylinders B and B and a pair of cylinders D and D, and a pair of stroke arms A and A. It is to be understood that in the other excavating machines disclosed herein, a similar redundancy of components is employed to provide the necessary strength, even though no Figure other than FIG. 2 expressly depicts the dual or redundant components.

Fifth Embodiment

Figure 12:
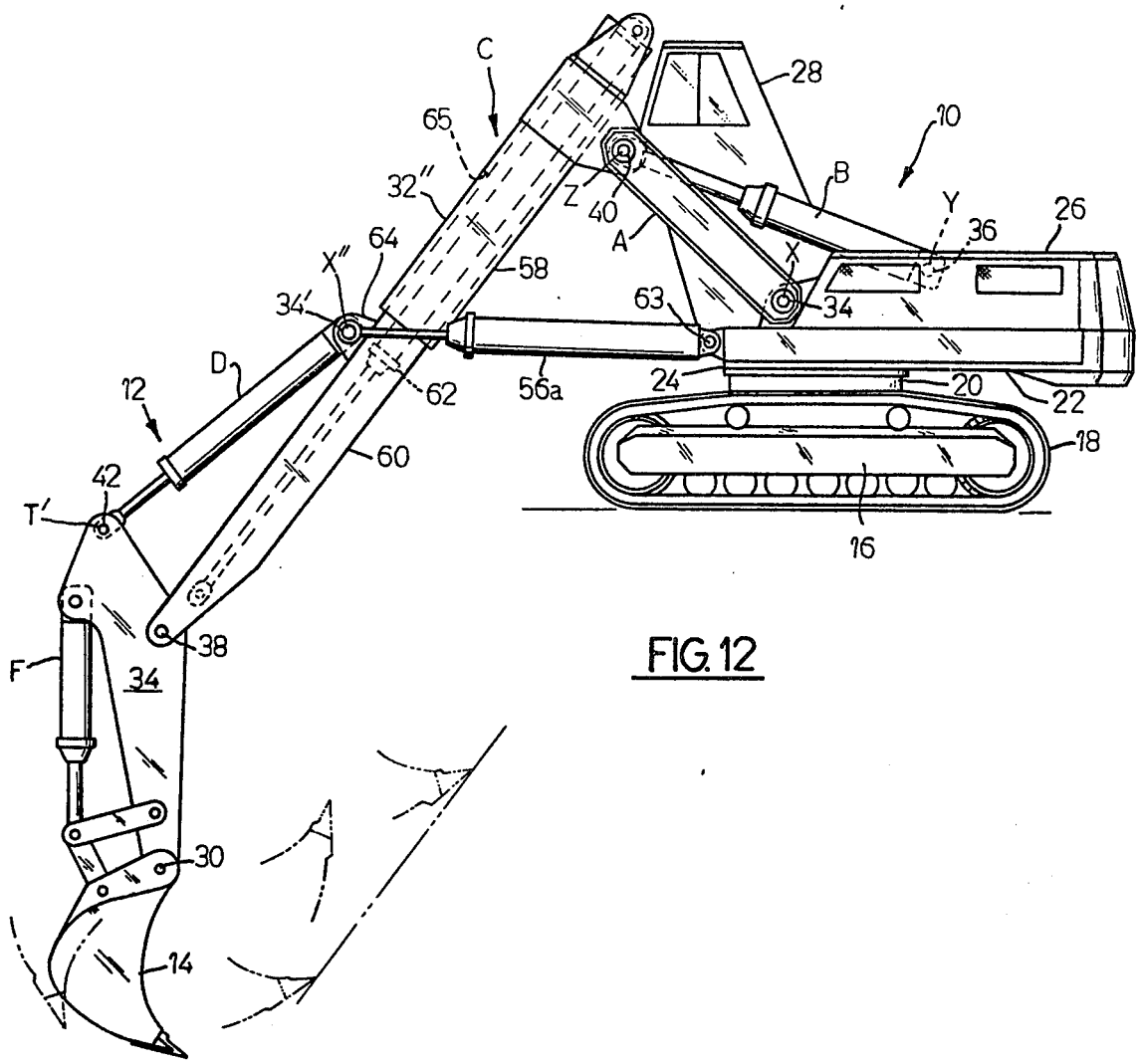
FIG. 12 is a side elevational view of an excavating machine in accordance with a fifth embodiment of the invention.
Figure 13:
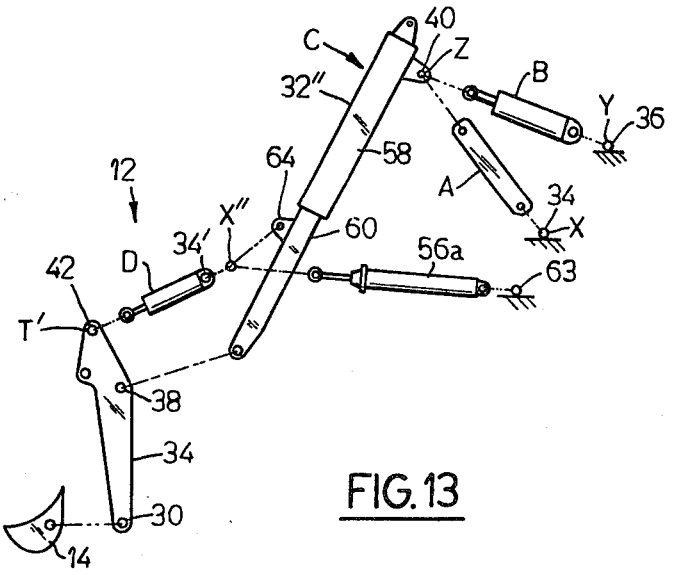
FIG. 13 is a schematic diagram of the machine shown in FIG. 12.
Figure 14:
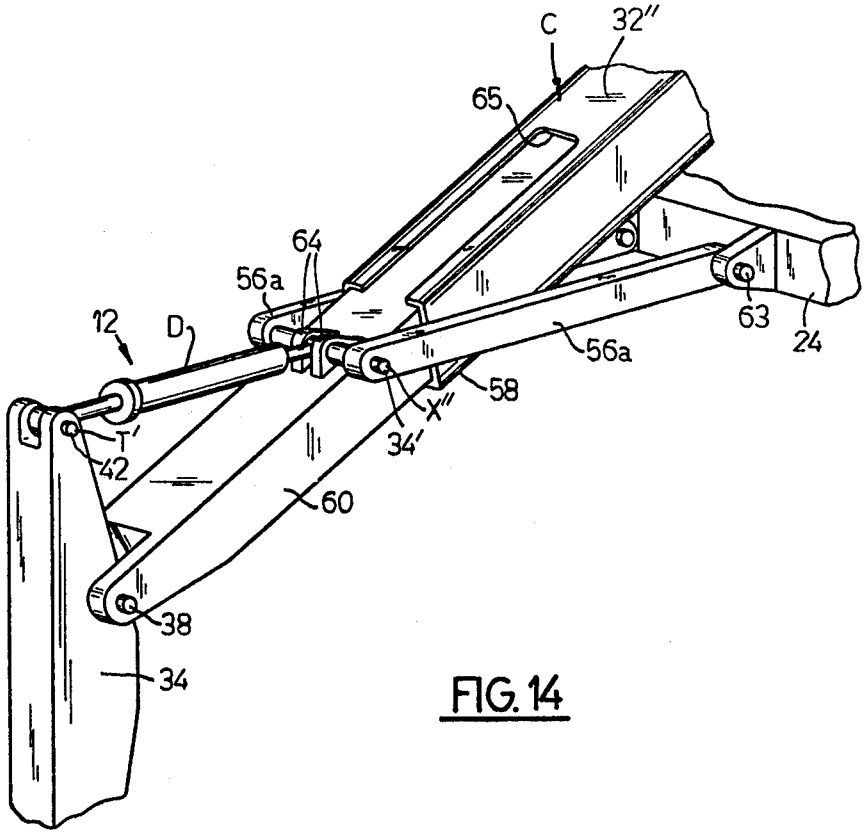
FIG. 14 is a perspective view of a portion of the machine shown in FIGS. 12 and 13.
Figure 15:
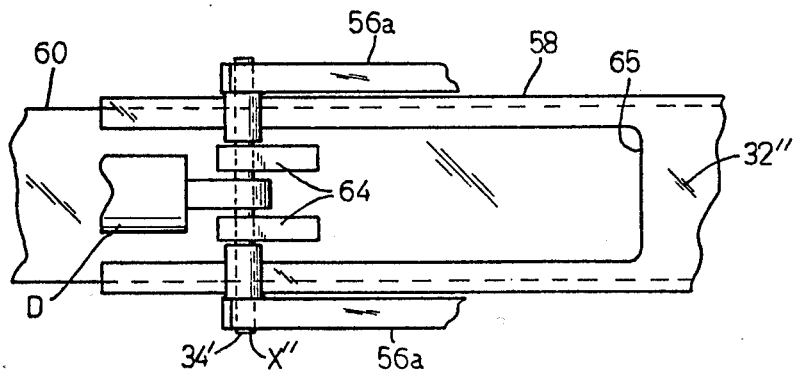
FIG. 15 is a top plan view taken on line 15—15 of FIG. 14.

Turning now to the embodiment of the invention shown in FIGS. 12 and 13, it is apparent that it is similar in all respects to the embodiment shown in FIGS. 7 and 11 except that the beam 56 of FIGS. 7 and 11 is replaced by an extendable and retractable hydraulic cylinder 56A which is pivotally connected to frame 22 at point 63 and is connected at its other end to a bearing shoe 64 on the upper side of boom portion 60. Boom portion 58 allows passage of shoe 64 in the same manner as shown in FIGS. 14 and 15 in connection with the emboidment shown in FIGS. 7 and 11. The embodiment shown in FIGS. 12 and 13 enables every desired angle of slope to be achieved. Furthermore, when cylinder 56A is totally extended and cylinder B is fully retracted, a higher unloading position for the shovel 14 can be achieved.

I claim:

1. In an excavating machine:

a frame;

shovel attachment means mounted on said frame near the working end of said machine; and a shovel mounted on said shovel attachment means; said shovel attachment means comprising:

a stroke arm having an upper end and a lower end;

first means for pivotally connecting said lower end of said stroke arm to a first point on said frame;

an extendable and retractable stroke arm cylinder having an upper end and a lower end for pivotally moving said stroke arm about said first point;

second means for pivotally connecting said lower end of said stroke arm cylinder to a second point on said frame;

third means for pivotally connecting said upper end of said stroke arm and said upper end of said stroke arm cylinder to a common point;

a shovel arm assembly having an upper end and a lower end;

said shovel arm assembly comprising a first beam section connected to said common point, a second beam section, means for pivotally connecting said second beam section to said first beam section; and wherein said shovel is connected to said second beam section;

fourth means for connecting said upper end of said shovel arm assembly to said common point;

an extendable and retractable shovel arm cylinder having an inner end and an outer end for pivotally moving said shovel arm assembly about said common point;

fifth means for indirectly pivotally connecting said inner end of said shovel arm cylinder to said frame;

sixth means for pivotally connecting said outer end of said shovel arm cylinder to a point on said shovel arm assembly spaced from said common point and near the upper end of said second beam section;

and means for connecting said shovel to said lower end of said shovel arm assembly.

2. An excavating machine according to claim 1 wherein said first point is nearer the working end of said machine than said second point; and wherein said stroke arm is a rigid beam.

3. In an excavating machine:

a mobile lower section;

a rotatable upper section mounted on said mobile lower section and comprising an upper frame having a working end;

shovel attachment means mounted on said upper frame and comprising:

a stroke arm having its lower end pivotally connected to a first point on said upper frame;

an extendable and retractable stroke arm cylinder for pivotally moving said stroke arm about said first point and having its lower end pivotally connected to a second point on said upper frame, said stroke arm and said stroke arm cylinder having their upper ends pivotally connected to each other at a common point;

a shovel arm assembly having its upper end pivotally connected to said stroke arm and said stroke arm cylinder at said common point;

said shovel arm assembly comprising a first beam section connected to said common point, a second beam section, means for pivotally connecting said second beam section to said first beam section; and wherein said shovel is connected to said second beam section;

an extendable and retractable shovel arm cylinder for pivotally moving said shovel arm assembly about said common point and having one end pivotally connected to said shovel arm assembly at a point near an end of said second beam section and having its other end indirectly pivotally connected to a fixed point relative to said upper frame;

and a shovel mounted on said shovel arm assembly near the lower end thereof.

4. An excavating machine according to claim 3 wherein said first point is nearer the working end of said machine than said second point; and wherein said stroke arm is a rigid beam.

* * * * *